US005782310A

United States Patent [19]

Lange

[11] Patent Number: 5,782,310

[45] Date of Patent: Jul. 21, 1998

[54] DRY HOLLOW STEM AUGERS

[76] Inventor: James E. Lange, P.O. Box 1670, LaPorte, Ind. 46350

[21] Appl. No.: 629,479

[22] Filed: Apr. 10, 1996

[51] Int. Cl.[6] ..... F21B 17/046; F21B 17/22

[52] U.S. Cl. ..... 175/323; 285/330; 175/394

[58] Field of Search ..... 175/323, 246, 175/313, 320, 57; 166/382, 115, 117.6; 285/330, 404

[56] References Cited

U.S. PATENT DOCUMENTS

| | | | |
|---|---|---|---|
| 2,088,759 | 8/1937 | Rassieur | 175/323 |
| 2,210,296 | 8/1940 | Kittrell et al. | 175/323 |
| 2,339,104 | 1/1944 | Phipps | 175/323 |
| 2,578,593 | 12/1951 | Phipps | 175/323 |
| 3,178,210 | 4/1965 | Dickinson | 175/323 |
| 3,187,825 | 6/1965 | Bower, Jr. | 175/323 |
| 3,986,570 | 10/1976 | Stinson et al. | 175/320 |
| 4,454,922 | 6/1984 | Jamison et al. | 175/323 |
| 4,821,818 | 4/1989 | Mefferd | 175/323 |
| 4,844,184 | 7/1989 | Acker, III et al. | 175/323 |
| 4,872,708 | 10/1989 | Abreo, Jr. | 285/39 |

*Primary Examiner*—Frank Tsay
*Attorney, Agent, or Firm*—Baker & Daniels

[57] ABSTRACT

Drilling augers comprise a tubular housing having an outer circumferential surface, with helical flighting mounted on the outer surface to effect drilling. Opposite ends of each auger terminate in a socket end connector and a plug end connector, the plug end connector of a succeeding auger received within the socket end connector to provide a connection between the augers. A circumferentially extending gasket seal is provided between the end of the plug end connector and a circumferentially extending rim on the socket end connector to prevent fluids from outside of the augers from leaking into the passage through the augers, and to prevent drilling fluids in the passage from leaking out. Pins carried by the socket end connector engage apertures in the plug end connector to provide a connection between the augers when the drilling string is withdrawn. Plug seals are snap fitted into the apertures and are held therein by a circumferentially extending rim engaging a surface surrounding the apertures.

15 Claims, 4 Drawing Sheets

DRY HOLLOW STEM AUGERS

This invention relates to hollow stem augers used for boring holes in the earths crust.

Drilling augers are used to bore holes in the earth's crust for many reasons. One common reason is to construct monitoring wells to sample water in aquifers at varying levels below the earth's surface. Another reason is to take soil samples at varying depths, commonly to determine if the soil is contaminated. Hollow stem augers are used in such drilling operations, in which the augers have a passage that extends through the drilling string formed by connecting augers together end to end so that sampling tools may be used to take samples and then extract them through the passage. Water samples can be taken in a similar way. Drilling fluids may be pumped through the passage in order to facilitate drilling.

Augers are commonly a few feet long, and are connected end to end as the drilling process proceeds. The joints between the augers comprising the drilling string provide a leak path in which water from an aquifer may leak into the passage within the hollow stem auger. Accordingly, if the drilling operation must proceed through a shallow aquifer before reaching a deeper aquifer that is to be sampled, a leak path may exist in which the aquifers may be cross contaminated, and the samples taken will not reflect the true condition of the deeper aquifer. Some prior art augers have been equipped with O-ring seals in an attempt to prevent leakage into the passage defined within the hollow stem auger; however, due to jarring and rocking of the augers, such seals have proven to be ineffective. Accordingly, the only way to assure that cross contamination will not occur is to set casing, which is relatively expensive. Furthermore, drilling fluids, if used, may leak, contaminating soil layers through which drilling is taking place and reducing the quantity of drilling fluid available at the end of the drilling string.

The joints between the hollow stem augers includes a thrust transmitting surface where compressive forces are exerted to effect drilling. Drive teeth spaced circumferentially around the joint provide a rotary driving connection between the augers. To enable the augers to be pulled out of the bore, bolts or threaded pins are used at the joints to interconnect the augers.

The present invention provides a resilient gasket between cooperating surfaces defined on the augers. Seal plugs are provided in apertures in one of a pair of augers which receive the ends of pins threaded on the other auger to permit the augers to be pulled out of the ground as a string. The seal plugs are made of plastic or similar resilient material and snapped into the apertures. Accordingly, fluid tight seals are provided at the leak points between the augers, thus assuring that ground water cannot leak into the passage, and that drilling fluids that might be used cannot leak out of the passage formed by the augers.

These and other advantages of the present invention will become apparent from the following description, with reference to the accompanying drawings, in which.

Figure 4:
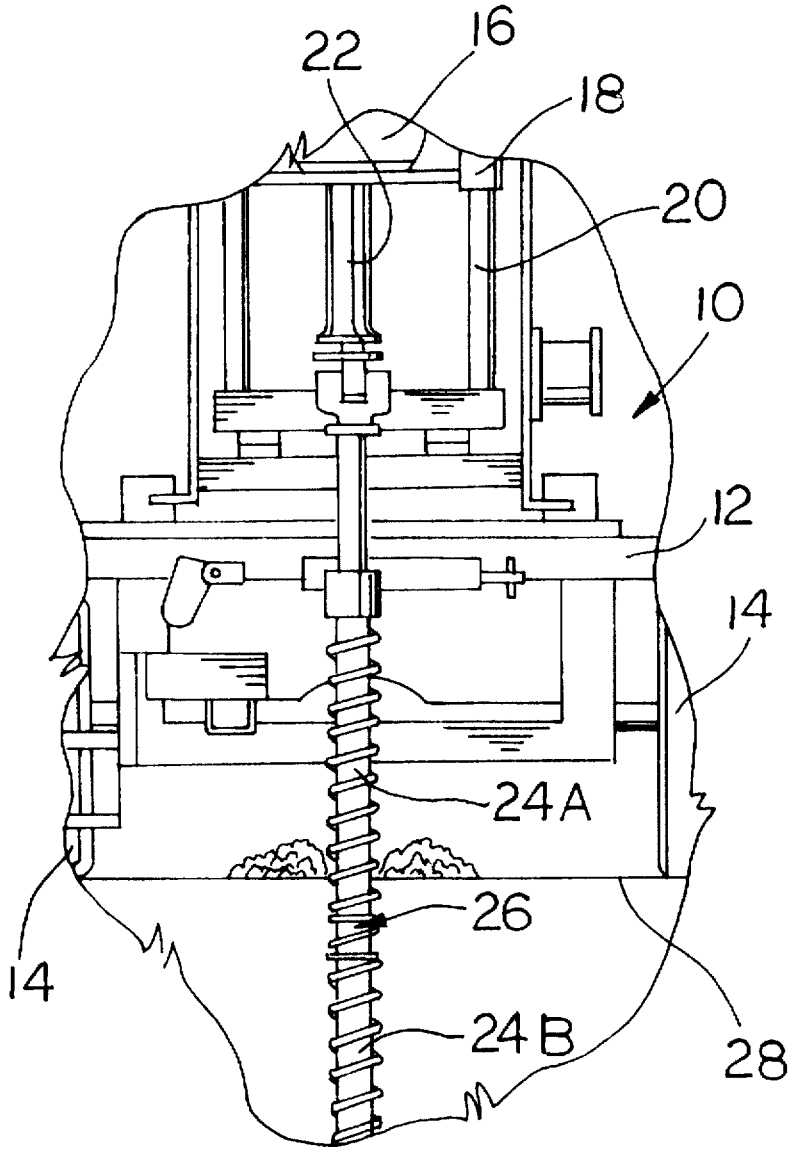
FIG. 4 is a fragmentary elevational view of the drilling stem and drilling augers installed on a drilling rig.

Referring now to FIG. 4 of the drawings, a drilling rig generally indicated by the numeral 10 is installed on a bed 12 of a truck, the rear wheels being shown at 14. When drilling, jacks (not shown) engage the ground to stabilize the truck. The drilling rig 10 includes a rotary box 16 slidably mounted on a feed frame 18 for vertical reciprocation along columns 20 with respect to bed 12. A drilling spindle adaptor 22 extends out of the rotary box 16. Augers 24A, 24B are connected to the spindle adaptor stem 22 for rotation by the rotary box 16 to affect drilling. The augers 24A, 24B are joined together at a coupling 26. The augers 24A, 24B, when rotated, bore into the earth as illustrated in FIG. 4, the ground level being indicated at 28. Although only two augers 24A, 24B are shown, it will be recognized that any reasonable number of augers may be similarly connected together to form a drilling string sufficiently long to bore into the earth to a desired depth.

Figure 1:
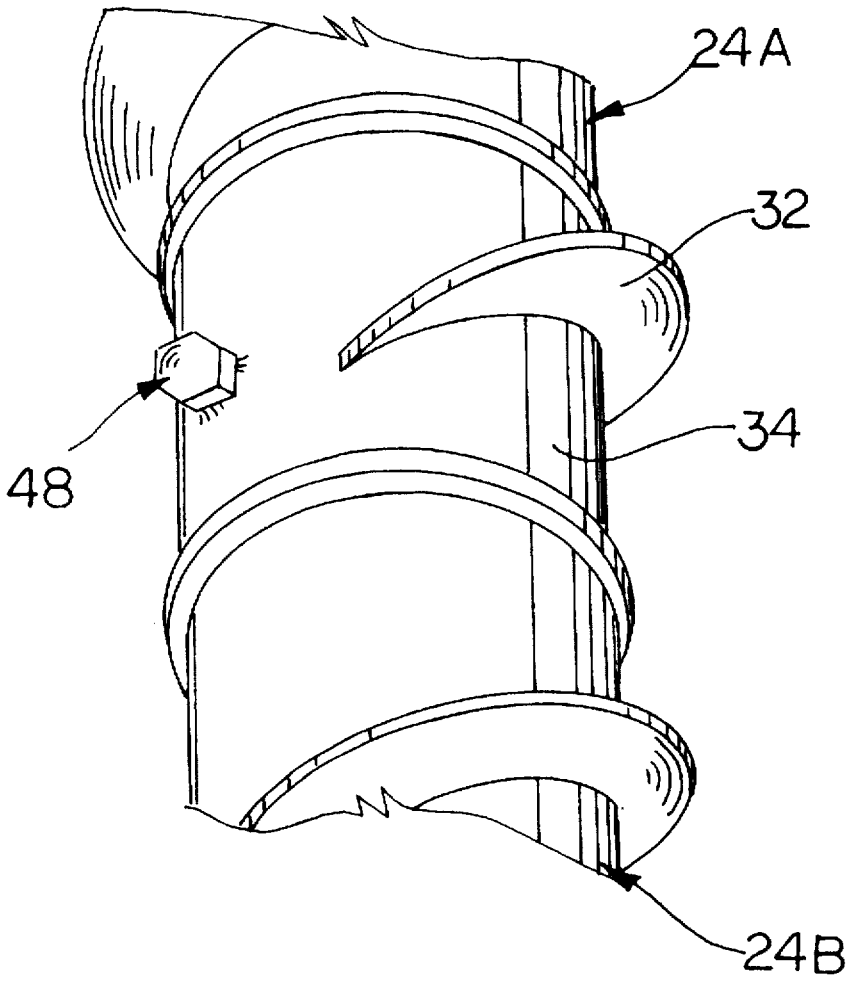
FIG. 1 is a fragmentary view in perspective of the joint between a pair of augers made according to the teachings of the present invention.
Figure 2:
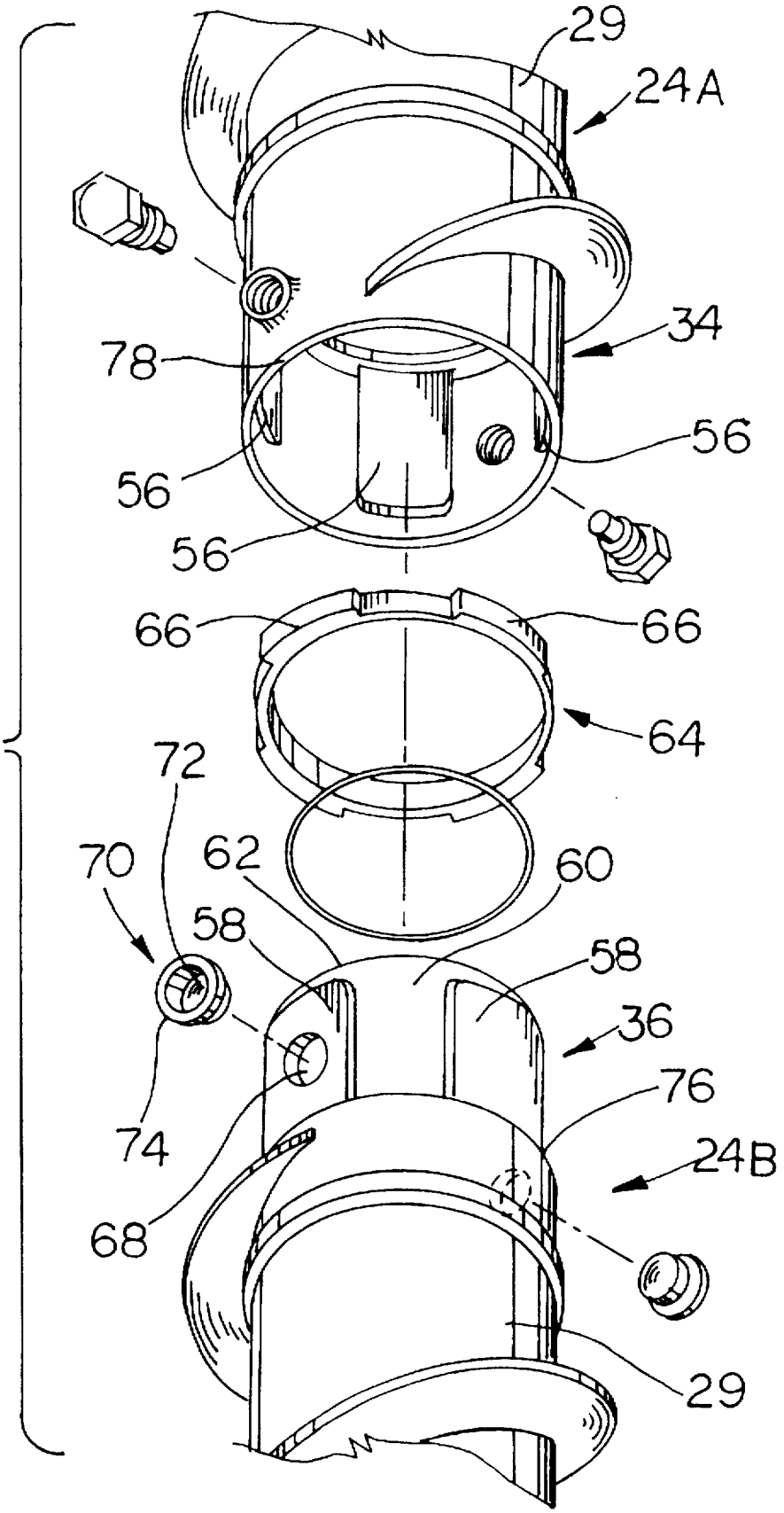
FIG. 2 is an exploded perspective view of the joint between two adjacent augers of the type illustrated in FIG. 1.
Figure 3:
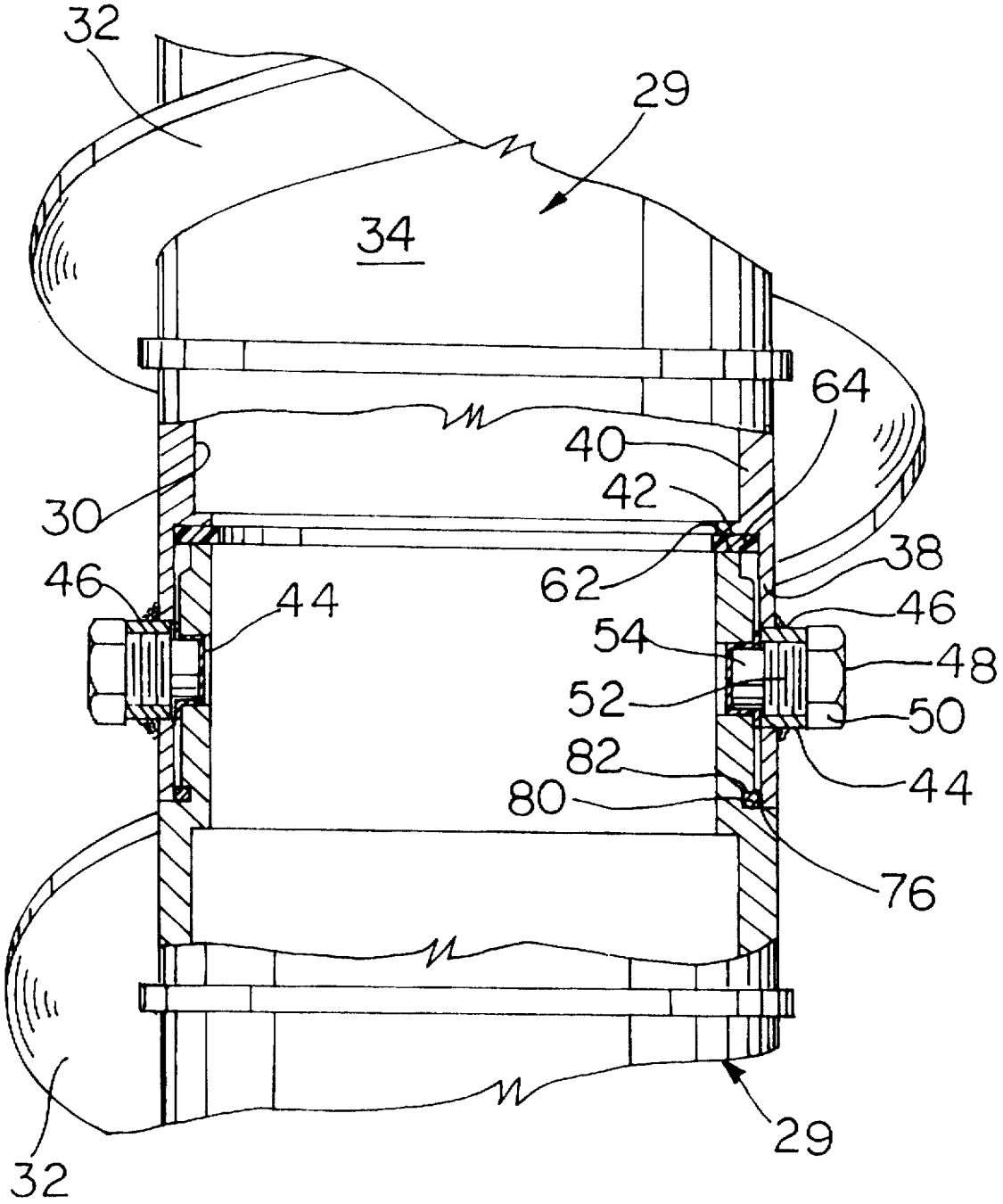
FIG. 3 is an enlarged fragmentary, longitudinal cross sectional view of the joint between two augers coupled together.

Referring now to FIGS. 1–3, each of the augers 24A, 24B includes a tubular housing 29 defining a passage 30 therewithin. The passage 30 extends uninterruptedly through augers 24A, 24B and through succeeding augers in the drilling string to enable boring tools to be operated through the passage 30 and to permit soil and water samples to be collected and removed through the passage 30. Conventional helical flighting 32 is mounted on the outer circumferential surface 29 of the augers by welding or by similar means.

One end of each of the hollow stem augers 24A, 24B terminates in a socket end connector generally indicated by the numeral 34 and the other end of each of the augers 24A, 24B terminates in a plug end connector generally indicated by the numeral 36, which is adapted to be received within the socket connector 34 of an adjoining auger such that augers may be connected together to form a drilling string sufficiently long to drill to desired depths. Socket end connector 34 includes a larger diameter portion 38 cooperating with a smaller diameter portion 40 of the tubular housing 29 to define a circumferentially extending, radially inwardly projecting rim 42 therebetween. Apertures 44 are provided in larger diameter portion 38 which receive threaded bushings 46 which are secured thereto by welding. The threaded bushings 46 threadedly receive pins generally indicated by the numeral 48, which include a hex head 50, an intermediate threaded portion 52 which threadedly connects with the bushings 46, and an unthreaded inner portion 54 which projects into the passage 30 for a purpose to be discussed hereinafter. Circumferentially spaced, radially inwardly projecting drive teeth 56 project into the passage 30 from the larger diameter portion 38 of the socket end connector 34. When the plug end connector 36 of an adjacent auger is received within the socket end connector 34, corresponding radially outwardly extending drive teeth 58 carried by the connecting portion 60 of the plug end connector 36 fit between the drive teeth 56 thereby forming a connection between the augers so that torque applied through the uppermost auger of drilling string 22 will be transmitted to succeeding augers through the teeth 56 and 58.

The portion 60 of plug end connector 36 terminates in a circumferentially extending surface 62. A gasket generally indicated by the numeral 64 is received within the socket connector 34 and is sized to rest on the rim 42. The gasket 64 includes circumferentially spaced, radially outwardly projecting ears 66 that fit between the teeth 56. When the plug connector 36 is installed within the socket connector 34, the surface 62 cooperates with the rim 42 to compress the gasket 64 to about two-thirds of its original height, thus providing a sealing connection between the surfaces 62 and 42.

The plug connector 36 includes circumferentially spaced apertures 68 which register with the apertures 44 in the socket end connector 34 when the plug end connector 36 is received within the socket end connector 34. The apertures 68 receive the unthreaded ends 54 of the pins 48, to thereby provide a connection between the augers 24A and 24B when the augers are withdrawn from the bore. Plug seals 70 are received within each of the apertures 68 and are sized to fit therein with a tight "snap" fit. Each of the plug seals 70 include a recessed portion 72 received within the apertures 68 and a circumferentially extending, radially outwardly projecting rim portion 74 which engages the portion 58 of plug end connector 36 to thereby provide a fluid tight seal closing the apertures 68. The recessed portion 72 of the plug seal 70 receive the unthreaded portion 54 of the pins 48 when the latter are installed therein. A shoulder 76 is defined between the recessed portion 60 and the circumferential surface of the tubular housing 29 and is engaged by circumferentially extending end surface 78 on the socket connector 34 to thereby regulate the degree of compression of the gasket 64. Circumferentially extending O-ring seal 80 is received within a notch 82 and sealingly engages the portion 38 of socket connector 34. However, due to the rocking and jarring that occurs between the augers during drilling, the O-ring seal 80 is insufficient in itself to prevent leakage into or out of the passage 30 defined within the augers 24A, 24B. Since the gasket seal 64 is compressed when the augers are connected together to a height of about two-thirds of its original height, effective sealing takes place between the surfaces 42 and 62. Furthermore, the plug seals 70 seal off the apertures 68, thereby preventing fluid leaking around the O-ring seal 80 from entering the passage 30 through this leak path. Accordingly, the passage 30 is sealed, thereby permitting the drill string consisting of the augers 24A, 24B and other augers connected in the drilling string, to drill through shallow aquifers without leakage into the passage 30 when a deeper aquifer is to be sampled. Furthermore, gasket 64 and the sealing plugs 30 assure that drilling fluids used to facilitate drilling will not leak out at the couplings between the augers.

I claim:

1. Drilling auger comprising a tubular housing having an outer circumferential surface, said housing including an inner circumferential surface defining a passage through the auger, helical flighting mounted on said outer circumferential surface, one end of said housing terminating in a socket connector and the other end of the housing terminating in a plug connector, said passage extending through said connectors, said socket connector including a circumferentially extending radially projecting rim, and a circumferentially extending sealing gasket mounted on said rim and extending radially outwardly from said inner circumferential surface for sealing against the plug connector of a succeeding housing when augers are connected together to form a drilling string to thereby resist fluid leakage into said passage from outside of the auger.

2. Drilling auger as claimed in claim 1, wherein said plug connector terminates in a circumferentially extending end surface extending outwardly from said inner circumferential surface, said socket connector, said socket connector including a circumferentially extending, radially inwardly projecting rim terminating at said inner circumferential surface, said end surface and said rim engaging said gasket.

3. Drilling auger as claimed in claim 2, wherein the plug connector includes an outer circumferential surface, the outer circumferential surface of the plug connector and a section of the inner circumferential surface of the housing within the socket connector carrying circumferentially spaced drive teeth, the drive teeth of the socket connector engaging the drive teeth of the plug connector to provide a rotary driving connection between the augers, said gasket including projecting portions extending between the drive teeth of the socket connector.

4. The drilling auger as claimed in claim 1, wherein radially extending pins carried by said socket connector extending into said plug connector, and seals preventing fluid leakage between said pins and said plug connector.

5. The drilling auger as claimed in claim 4, wherein said pins are received within apertures in said plug connector, said seals being plug seals mounted in said apertures, said plug seals defining a cavity receiving a corresponding one of said pins.

6. The drilling auger as claimed in claim 5, wherein each of said plug seals include a recessed portion received within said apertures and a rim circumscribing said recessed portion, said rim engaging the portion of the plug connector circumscribing the corresponding aperture.

7. The drilling auger as claimed in claim 6, wherein the pins include a threaded portion threadedly engaging said socket connector and an unthreaded portion extending from the threaded portion, said unthreaded portion of each pin engaging the recessed portion of the corresponding plug seal.

8. Drilling auger comprising a tubular housing having an outer circumferential surface, said housing defining a passage through the auger, helical flighting mounted on said outer circumferential surface, one end of said housing terminating in a socket connector and the other end of the housing terminating in a plug connector, said passage extending through said connectors, radially extending pins carried by one of said connectors extending into the other connector, and seals preventing fluid leakage between said pins and said plug connector, said pins being received within apertures in said plug connector, said seals being plug seals mounted in said apertures, said plug seals defining a cavity including a recessed portion extending transversely across said pins, said cavity receiving a corresponding one of said pins.

9. Drilling auger as claimed in claim 8, wherein each of said recessed portions is received within said apertures, said seals further including a rim circumscribing said recessed portion, said rim engaging the portion of the plug connector circumscribing the corresponding aperture.

10. Drilling auger as claimed in claim 9, wherein the pins include a threaded portion threadedly engaging said socket connector and an unthreaded portion extending from the threaded portion, said unthreaded portion of each pin extending into the recessed portion of the corresponding plug seal.

11. A drilling string comprising a pair of augers, each of said augers including a housing having an outer circumferential surface, each of said housings defining a passage extending therethrough communicated with the passage of the other auger, helical flighting mounted on the outer circumferential surfaces of said housings, cooperating circumferentially extending, radially projecting surfaces on each auger defining a gap therebetween, each of said surfaces extending to said passage and sealingly engaging first sealing means between said surfaces for sealing between said augers, said first sealing means extending outwardly from said passage cooperating force transmitting means on each auger for connecting said augers to permit one auger to pull on the other auger, and cooperating second sealing means for providing sealing between the second force transmitting means.

12. The drilling string as claimed in claim 11, wherein the said first sealing means includes a gasket between said surfaces.

13. The drilling string as claimed in claim 11, wherein the cooperating surfaces include a circumferentially extending rim on one of said augers and a circumferentially extending end surface on the other auger, said first sealing means including a gasket between said rim and said end surface.

14. The drilling string as claimed in claim 11, wherein said second force transmitting means includes a radially extending pin carried by one of the augers, said pin being received in an aperture in the other auger, said second sealing means being a seal between said aperture and said pin.

15. The drilling string as claimed in claim 14, wherein said last-mentioned seal is a plug seal carried by said other auger and extending across and closing said aperture, said plug seal including a portion projecting into said aperture and receiving said pin.

* * * * *